US012790931B2

(12) United States Patent
Aertker et al.

(10) Patent No.: US 12,790,931 B2
(45) Date of Patent: Nov. 10, 2026

(54) IN SITU LEACH MINING USING ELECTRICAL RESERVOIR STIMULATION

(71) Applicant: Eden GeoPower, Inc., Somerville, MA (US)

(72) Inventors: William Aertker, Denver, CO (US); Vikas Agrawal, Medford, MA (US); Jonas Toupal, Somerville, MA (US); Rafael Villamor-Lora, Brookline, MA (US)

(73) Assignee: Eden GeoPower, Inc., Somerville, MA (US)

( * ) Notice: Subject to any disclaimer, the term of this patent is extended or adjusted under 35 U.S.C. 154(b) by 0 days.

(21) Appl. No.: 19/536,420

(22) Filed: Feb. 11, 2026

(65) Prior Publication Data

US 2026/0168369 A1 Jun. 18, 2026

Related U.S. Application Data

(63) Continuation of application No. PCT/US2025/042368, filed on Aug. 18, 2025.

(60) Provisional application No. 63/693,502, filed on Sep. 11, 2024.

(51) Int. Cl.

| | |
|---|---|
| ***E21B 43/24*** | (2006.01) |
| ***E21B 43/28*** | (2006.01) |
| ***E21B 43/29*** | (2006.01) |
| ***E21C 41/22*** | (2006.01) |

(52) U.S. Cl.

CPC ..... *E21B 43/283* (2013.01); *E21B 43/29* (2013.01); *E21C 41/22* (2013.01)

(58) Field of Classification Search

CPC .... E21B 43/283; E21B 43/2401; E21B 43/29; E21B 43/26; E21B 43/2405; E21B 43/28; E21C 41/22

See application file for complete search history.

(56) References Cited

U.S. PATENT DOCUMENTS

| | | | | |
|---|---|---|---|---|
| 3,775,099 | A * | 11/1973 | Coffield | C22B 15/0078 423/150.5 |
| 4,206,024 | A * | 6/1980 | Carpenter | E21B 43/17 205/766 |
| 6,199,634 | B1 * | 3/2001 | Selyakov | E21B 43/2401 166/250.01 |
| 9,644,466 | B2 * | 5/2017 | Symington | E21B 43/2401 |
| 11,091,991 | B1 | 8/2021 | Mehrvand et al. | |
| 11,319,788 | B1 | 5/2022 | Shumway | |
| 2011/0035154 | A1 * | 2/2011 | Kendall | C04B 28/10 422/111 |

(Continued)

OTHER PUBLICATIONS

International Search Report and Written Opinion mailed Oct. 7, 2025 in connection with International Application No. PCT/US2025/042368 (E0616.70012WO00).

*Primary Examiner* — Carib A Oquendo

(74) *Attorney, Agent, or Firm* — Wolf, Greenfield & Sacks, P.C.

(57) ABSTRACT

An electrical reservoir stimulation enhanced in situ leach mining system includes a plurality of wells in communication with an ore body. The wells include one or more injection wells and one or more extraction wells and at least two of the wells include electrodes. A power distribution system electrically stimulates the ore body via the electrodes to increase permeability of the ore body and/or enhance leaching operations.

30 Claims, 6 Drawing Sheets

(56) References Cited

U.S. PATENT DOCUMENTS

| | | | | |
|---|---|---|---|---|
| 2014/0014349 | A1 | 1/2014 | Mason | |
| 2014/0015449 | A1 | 1/2014 | Biester et al. | |
| 2015/0337410 | A1 | 11/2015 | Dimitrakis et al. | |
| 2023/0020716 | A1 | 1/2023 | Mehrvand et al. | |
| 2023/0020770 | A1 | 1/2023 | Alali et al. | |
| 2023/0085175 | A1* | 3/2023 | Smalls | C09K 8/64 166/250.01 |
| 2024/0117467 | A1 | 4/2024 | Li et al. | |

* cited by examiner

IN SITU LEACH MINING USING ELECTRICAL RESERVOIR STIMULATION

CROSS REFERENCE TO RELATED APPLICATIONS

This application is a continuation of PCT International Patent Application No. PCT/US2025/042368, filed Aug. 18, 2025, which claims the priority under 35 U.S.C. § 119 to U.S. Provisional Application No. 63/693,502, filed Sep. 11, 2024, the contents of which are incorporated herewith by reference in their entirety.

FIELD

The present disclosure relates to in situ leach mining (ISL). More particularly, the disclosure is related to employing electrical reservoir stimulation (ERS) to enhance ISL.

BACKGROUND

Mining is capital expenditure intensive, reaching $70.4 billion for the top 20 mining companies. Traditional mining also can require 10-20 years of site development—prospecting, analyzing samples, planning, building access roads, processing facilities, environmental management systems, maintenance facilities, offices, and employee housing—before the mine is ready for the production phase conducted by open pit or underground mining methods. Mine production is often environmentally destructive, and current practices require mine site reclamation by remediation, restoration, and rehabilitation. The long-term cost of reclamation can reach $15 billion for a single site.

As such, the mining industry continues to face increasing challenges including: 1) rapid depletion of high-profit deposits mined by conventional methods; 2) increased beneficiation costs (e.g., comminution); 3) expensive management of tailings; 4) increased difficulty obtaining mine permits; and 5) increasing remediation cost and regulatory complexity. These challenges lead to reduced profitability and return on investment. The current mining state-of-the-art has no simple solution to the increasing costs.

In contrast, in ISL, a significant proportion of hydrometallurgical processing of the ore body is transferred into the subsurface to target readily soluble evaporite minerals, metallic ore minerals, and silicates such as spodumene and clays. Consequently, ISL reduces the cost to mine by having: 1) minimal surface disturbance by destructive open pit and underground mining; 2) less mine site preparation (e.g., infrastructure); 3) no comminution required and therefore, no crushing or grinding required and no tailings produced; and 4) reduced site reclamations due to minimal surface disruptions.

ISL was introduced in 1959 for uranium roll-front deposits in the USA. The intrinsic permeability associated with sedimentary-hosted uranium roll-front deposits allows ISL to be an ideal mining method. ISL for uranium is conducted in many countries and accounted for 51% of world production in 2014. Copper recovery by ISL was introduced in 1970, yielding several successful tests at mines. In addition to copper, ISL for nickel, rare earth elements, gold, and scandium has been further developed. Other critical minerals (e.g., scandium, rhenium, rare earth elements, yttrium, selenium, molybdenum, and vanadium) were occasionally mined.

However, in ISL, the ores require leaching reactions with acids, other chemical lixiviants, such as chelating agents, and/or oxidizing agents targeting the redox-sensitive mineral, with the ultimate goal of recovering a critical-mineral-impregnated solution at the surface. As such, for ISL to be successful, ore deposits need to be permeable by either naturally or artificially induced processes. Permeability is the primary governing petrophysical parameter limiting ISL. Natural permeability in the ore is often restricted and relies upon voids, fractures, and vugs. In the case of metallic minerals derived from a metal-bearing hydrothermal ore genesis within fractures, the pre-existing fractures are often targeted to permeate leachate solutions in ISL. The applicability of ISL also depends on local geologic constraints including the aforementioned permeability, as well as hydrogeological conditions and selective leachability. One of these constraints is whether the critical minerals of interest are readily amenable to dissolution by leaching solutions (e.g., water, acids, chelating agents, alkaline solutions) in a reasonable period. Other parameters that affect ISL's applicability are the morphology and depth of mineralization, ore thickness and grades, localized or disseminated ore, aquicludes, brine composition, and environmental conditions (e.g., groundwater contamination).

The economics for ISL are also different than conventional mining methods. The capital expenditure, operational expenditure, and common cut-off grades (e.g., copper, gold, nickel, scandium, rhenium, rare earth elements, yttrium, selenium, molybdenum, vanadium) for ISL are different due to ISL enabling production to start at lower capital cost and then involving a modular increase in production, as well as very flexible production capacity, compared to traditional mining. Even so, ISL has its drawbacks depending on geology and other factors. Thus, an improved method and system for ISL mining is desired and has been developed and disclosed herein.

BRIEF DESCRIPTION OF DRAWINGS

Embodiments of the subject matter are disclosed with reference to the accompanying drawings and are for illustrative purposes only. The subject matter is not limited in its application to the details of construction or the arrangement of the components illustrated in the drawings. Like reference numerals are used to indicate like components, unless otherwise indicated.

DETAILED DESCRIPTION

Figure 1:
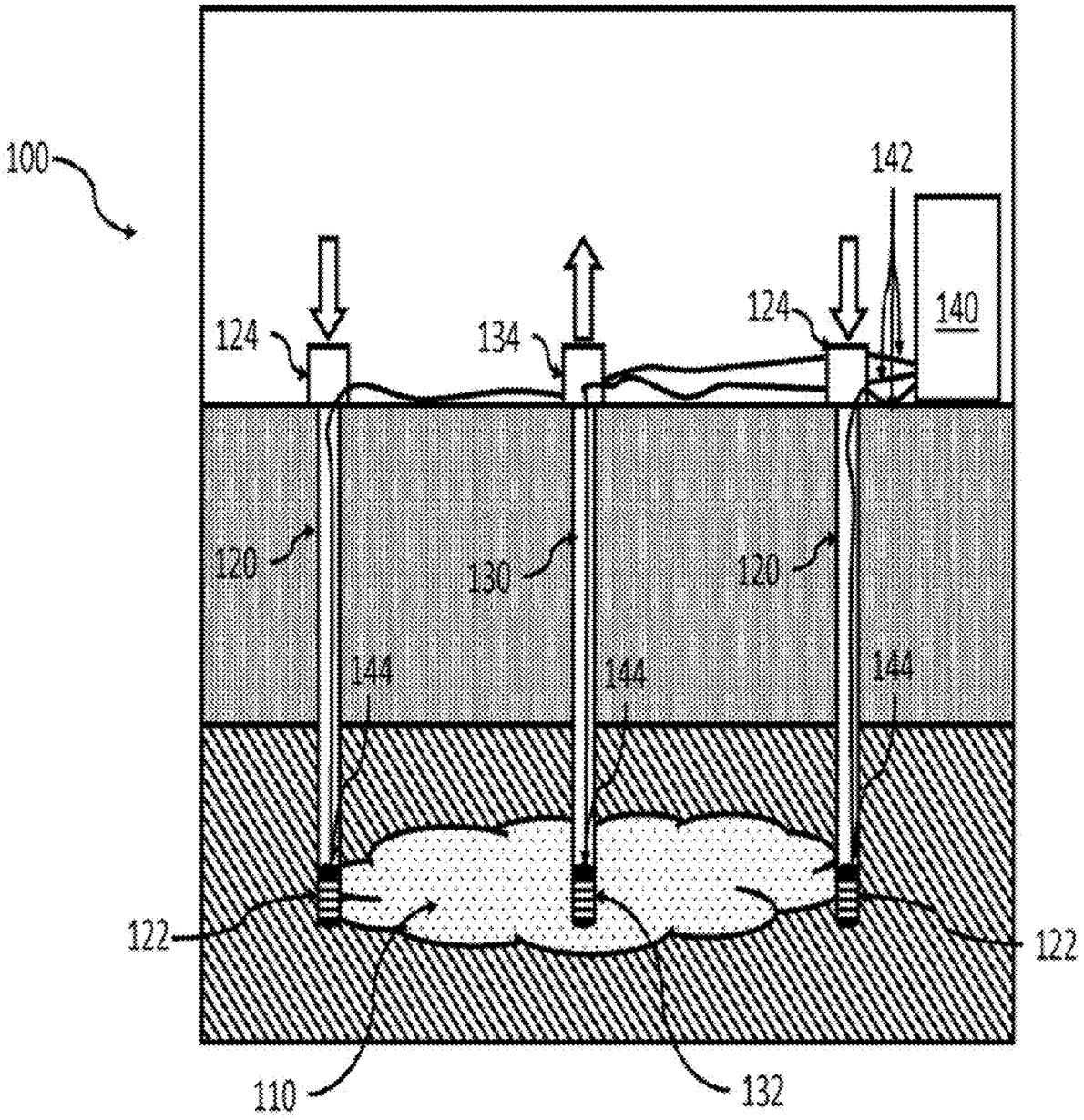
FIG. 1 is a diagrammatic cross-section of an electrical reservoir stimulation enhanced in-situ leaching (hereinafter "ESR-ISL") system, according to some embodiments.

The following descriptions are provided to explain and illustrate embodiments of the present disclosure. The described examples and embodiments should not be construed to limit the present disclosure.

ISL mining employs leachate solutions (e.g., water, acids, chelating agents, alkaline solutions) to recover critical minerals from an ore deposit without the need to extract the rock for comminution and leaching. There are broadly two types of solution mining: 1) in-situ and 2) in-place. In the case of in-place, permeability enhancement techniques such as blasting or previous mining activities (e.g., block-caving) may be used to fragment the ore to increase permeability before injection of the leaching solution to recover critical minerals. In-situ methods depend solely on the intrinsic permeability of the ore. Both flooded leach and percolation leaching may be employed in ISL. Flooded leaching is when the ore body is saturated with a single-phase solution below the water table, or otherwise contained. Percolation leaching involves a downward gravitation flow of two-phase (i.e., liquid and air) unsaturated solutions within the ore body.

ISL mining is already a major source of metals in the United States. ISL mining is primarily constrained to water-soluble salts such as sylvite, halite, thenardite (sodium sulfate), and nahcolite (sodium bicarbonate) within intrinsically permeable sedimentary deposits. Other commodities, such as sulfur, are melted by superheated water for recovery at the surface. Uranium recovery via ISL from, e.g., uranium roll-front deposits using sulfuric acid, ammonium carbonate, and hydrogen peroxide presently accounts for 91% of uranium mined in the United States. Other commodities, such as copper, silver, and gold, are targets for ISL and account for approximately 30% of primary production in the United States. In the instance of copper, ISL replicates the natural dissolution and reprecipitation of redox-sensitive sulfides. Sulfide minerals such as pyrite ($FeS_2$), chalcopyrite ($CuFeS_2$), and bornite ($CU_5FeS_4$) are oxidized. The oxidation of iron contained within these minerals is converted to iron oxide, and sulfur is combined with groundwater to produce a weak sulfuric acid solution. Critical minerals such as copper are dissolved in the weak sulfuric acid solution until reducing conditions dominate to promote the precipitation of chalcocite ($Cu_2S$). Over time, this forms a highly economically oxidized zone (i.e., a leached cap) above a thick, copper-rich blanket-shaped zone. ISL can also replicate this process by directly injecting oxidizing agents via injection wells into the copper-bearing ores. The movement of the fluids through the ore is controlled by pumping solutions from neighboring recovery wells creating a hydraulic gradient to flow from the injection well to the recovery well. Recovery of other commodities, such as gold, has been attempted by ISL using chloride and iodide solutions. ISL may also be used to desorb critical minerals from clays and organic matter; critical minerals such as Li may be adsorbed in clay and metals such as V, Cr. And Ni may be adsorbed in organic matter. While various distances may be suitable, in one embodiment the injection and recovery well(s) may be spaced 40-500 feet apart, and in one preferred embodiment they may be spaced 50-200 feet apart.

As discussed above, limiting factors for using ISL include permeability of the ore body and dissolution and/or desorption rate of the minerals within the ore body. However, as will be appreciated in the present disclosure, the ERS-ISL system 100 overcomes these limitations and greatly expands the capabilities, cost-effectiveness, and yield of traditional ISL.

Turning to FIG. 1, an ERS-ISL system 100 according to an embodiment of the present disclosure is depicted. One or more injection wells 120 are used to inject a recovery solution or leachate solution into a subterranean ore body 110. In some embodiments, the recovery solution may be electrically conductive. In some embodiments, the recovery solution may include a leachate comprising one or more organic acids (e.g., carboxylic acids or dicarboxylic acids), oxidizing agents, water, brines, acidic solutions, alkaline solutions, chelating agents, or combinations thereof. In some embodiments, the recovery solution comprises a carbonate-forming species such as malonic acid, succinic acid, $CO_2$-saturated brine, super critical $CO_2$, oxalic acid, citric acid, or combinations thereof. In some embodiments, the recovery solution comprises a proppant, such as a conductive proppant or a non-conductive proppant. The recovery solution is selected in type and concentration and amount to facilitate dissolving and/or desorbing target ore deposits within the ore body 110 to form a target-mineral-bearing solution (hereinafter "enriched solution"), which is then pumped from the ore body 110 to the surface through one or more extraction wells 130. For example, for uranium ISL, a 0.1% to 1.0% by volume sulfuric acid solution may be used as the recovery solution. In some embodiments, the recovery solution comprises an acid at a concentration of 1-50 g/L, 1-35 g/L, 5-50 g/L, or 5-20 g/L. Any suitable method may be used to recover the minerals from the recovery solution including, but not limited to, ion exchange, solvent extraction, precipitation, electrowinning, evaporation, and/or membrane filtration. Spent recovery solvent (having minerals extracted therefrom) may be disposed of via deep well injection or in evaporation ponds and/or may be treated and released into surface water bodies.

In some embodiments, a recovery solution may be used to facilitate fracturing of a subterranean formation in combination with the methods and systems disclosed herein. Again, the recovery solution may include a leachate and depending on the embodiment a conductive proppant or non-conductive proppant. The process works with the absence of conductive proppants by using conduct fluids (e.g., brines) and (or) intrinsic conductive pathways in the ore body (e.g., sulfide and oxide veins) to facilitate fracturing.

Non-limiting examples of conductive proppant include ceramic particles (e.g., electrically conductive ceramic particles), coated particles (e.g., particles coated with a conductive material such as a conductive metal or other conductive material, conductive composite particles where the composite particles include a non-conductive and conductive material), carbon particles (e.g., carbon black, acetylene black, petroleum coke), and metal particles (e.g., stainless steel shot).

For some embodiments, the conductive proppant comprises an electrically conductive portion and an electrically non-conductive portion. For example, the conductive proppant can be a core-shell material in which the exterior shell comprises an electronically conductive material (e.g., a metallic coating) and the interior core comprises an electrically non-conductive material (e.g., silica). In some embodiments, the electrically conductive portion and the electrically non-conductive portion are in a mixed arrangement, wherein portions of the electrically conductive portion are intermingled with one another. For example, particles of a conductive proppant may be mixed with separate particles of a non-conductive proppant. Other configurations of the electrically conductive portion and the electrically non-conductive portion are possible. Of course, in other embodiments, the conductive proppant comprises only an electrically conductive portion, such that the entirety of the conductive proppant comprises an electrically conductive material.

In embodiments in which a recovery solution includes a proppant including a portion that is non-conductive, the electrically non-conductive proppant material may correspond to any appropriate non-conductive proppant material compatible with the processes described herein. Non-limiting examples of electrically non-conductive materials include alumina ($Al_2O_3$), silica ($SiO_2$). In some embodiments, the electrically non-conductive material is coated or mixed with an electrically conductive material (e.g., a metallic coating, a conductive carbon material) as noted above.

In some embodiments, the proppant comprises an electronically conductive material with a conductivity greater than or equal to $1\times10^2$ S/m, greater than or equal to $5\times10^2$ S/m, greater than or equal to $1\times10^3$ S/m, greater than or equal to $5\times10^3$ S/m, greater than or equal to $1\times10^4$ S/m, greater than or equal to $1\times10^5$ S/m, greater than or equal to $1\times10^6$ S/m, or greater than or equal to $1\times10^7$ S/m. In some embodiments, the conductivity of the electronically conductive material is less than or equal to $1\times10^7$ S/m, less than or equal to $1\times10^6$ S/m, less than or equal to $1\times10^5$ S/m, less than or equal to $1\times10^4$ S/m, less than or equal to $5\times10^3$ S/m, less than or equal to $1\times10^3$ S/m, less than or equal to $5\times10^2$ S/m, or less than or equal to $1\times10^2$ S/m. Combinations of the foregoing ranges are also contemplated (e.g., greater than or equal to $1\times10^2$ S/m and less than or equal to $1\times10^7$ S/m). Other ranges are possible as this is disclosure is not so limited.

In some embodiments, the conductivity of the recovery fluid is greater than or equal to 100 S/m, greater than or equal 150 S/m, greater than or equal 200 S/m, greater than or equal 250 S/m, greater than or equal 300 S/m, greater than or equal 500 S/m, greater than or equal 750 S/m, greater than or equal 1,000 S/m, greater than or equal 1,250 S/m, greater than or equal 1,500 S/m, greater than or equal 1,750 S/m, greater than or equal 2,000 S/m, greater than or equal 2,500 S/m, greater than or equal 3,000 S/m, greater than or equal 3,500 S/m, greater than or equal 4,000 S/m, greater than or equal 4,5000 S/m, or greater than or equal 5,000 S/m, greater than or equal. In some embodiments, the conductivity of the recovery fluid is less than or equal to 5,000 S/m, less than or equal to 4,500 S/m, less than or equal to 4,000 S/m, less than or equal to 3,500 S/m, less than or equal to 3,000 S/m, less than or equal to 2,500 S/m, less than or equal to 2,000 S/m, less than or equal to 1,750 S/m, less than or equal to 1,500 S/m, less than or equal to 1,250 S/m, less than or equal to 1,000 S/m, less than or equal to 750 S/m, less than or equal to 500 S/m, less than or equal to 300 S/m, less than or equal to 250 S/m, less than or equal to 200 S/m, less than or equal to 150 S/m, or less than or equal to 100 S/m. Combinations of the foregoing ranges are also possible (e.g., greater than or equal to 2,000 S/m and less than or equal to 5,000 S/m). Other ranges are possible as this disclosure is not so limited.

In some embodiments, a conductive proppant is dispersed and/or suspended in the transport fluid including, but not limited to water (e.g., freshwater, brine), compressed gas (e.g., liquefied petroleum gas), or carbon dioxide (e.g., supercritical carbon dioxide), as described herein.

In some embodiments, the transport fluid is present at a particular amount within the recovery solution. In some embodiments, the transport fluid is greater than or equal to 10 wt %, greater than or equal to 20 wt %, greater than or equal to 30 wt %, greater than or equal to 50 wt %, greater than or equal to 70 wt %, greater than or equal to 90 wt %, greater than or equal to 95 wt %, or greater than or equal to 99 wt % of the total weight of the recovery solution. In some embodiments, the transport fluid is less than or equal to 99 wt %, less than or equal to 95 wt %, less than or equal to 90 wt %, less than or equal to 70 wt %, less than or equal to 50 wt %, less than or equal to 30 wt %, less than or equal to 20 wt %, or less than or equal to 10 wt % of the total weight of the recovery solution. Combinations of the foregoing ranges are also possible (e.g., greater than or equal to 10 wt % and less than or equal to 99 wt %). Other ranges are possible.

In some embodiments, the conductive proppant is present at a particular amount within the recovery solution. In some embodiments, the conductive proppant is greater than or equal to 0.1 wt %, greater than or equal to 0.5 wt %, greater than or equal to 1 wt %, greater than or equal to 3 wt %, greater than or equal to 5 wt %, greater than or equal to 10 wt %, greater than or equal to 15 wt %, or greater than or equal to 20 wt % of the total weight of the recovery solution. In some embodiments, the conductive proppant is less than or equal to 20 wt %, less than or equal to 15 wt %, less than or equal to 10 wt %, less than or equal to 5 wt %, less than or equal to 3 wt %, less than or equal to 1 wt %, less than or equal to 0.5 wt %, or less than or equal to 0.1 wt % of the total weight of the recovery solution. Combinations of the foregoing ranges are also possible (e.g., greater than or equal to 0.1 wt % and less than or equal to 20 wt %). Other ranges are possible.

The system, apparatus, and method disclosed herein may be used for ore deposits such as, but not limited to, magmatic sulfide deposits, volcanogenic massive sulfide deposits, komatiite-hosted sulfide deposits, porphyry deposits, iron oxide copper gold deposits, both high and low sulfidation epithermal deposits, skarn deposits, polymetallic carbonate replacement deposits, orogenic gold deposits, sedimentary exhalative deposits, lithium deposits (e.g., lithium-cesium-tantalum pegmatites, sedimentary lithium deposits), placer deposits, rare earth element carbonatites, Mississippi valley type deposits, shale deposits, coal deposits, and other deposit types.

Subterranean pumps 132 may be positioned on the injection wells 130 to force the recovery solution into the ore body 110 and subterranean pump 122 may be positioned on the extraction well 130 to aid in recovery of the enriched solution. The ERS-ISL system 100 may include additional wells (not shown) for monitoring conditions of the site and/or for controlling or adjusting conditions (e.g., by increasing pressure around the ore body 110). Although two injection wells 120 and one extraction well 130 are shown in FIG. 1, any number of injection and extraction wells may be used. Each well 120, 130 may include a wellhead 124, 134 including any requisite equipment for operating the ERS-ISL system 100 (e.g., pumps, monitoring equipment, valves, etc.).

The ERS-ISL system 100 also includes a power distribution system 140 for providing power to electrodes within two or more of the wells 120, 130. The power distribution system 140 directs electricity through lines 142 to electrodes 144 for electric stimulation of the ore body 110. The electrodes 144 are positioned within wells 120, 130 such that they are electrically connected, or capable of being electrically connected, to the ore body 110.

In some embodiments, the electrodes 144 may be spaced downhole about 50 to 1500 ft from one another. In some embodiments, every injection well 120 and every extraction well 130 includes a respective electrode 144. In other embodiments, one or more of the wells 120, 130 does not include an electrode 144. In any embodiment, the ERS-ISL system 100 includes at least 2 electrodes 144, of which at least one is a cathode and at least one is an anode. In some embodiments, the number of electrodes 144 is even and consists of paired anodes and cathodes.

According to one or more embodiments, the power distribution system 140 may include a controller to monitor and control the electrical stimulation process. The controller may be in communication with one or more sensors (pressure sensors, temperature sensors, voltmeters, current meters, etc.) and may automatically adjust parameters such as current, voltage, or pulse profile based on feedback from such sensors. In some embodiments, pulse width may be in a range between approximately 10 microseconds and 10 seconds, pulse repetition rate may be in a range between approximately 1 and approximately 100 kHz, and voltage may be in a range between approximately 1 kV and 500 kV, 5 kV and 500 kV, or 50 kV and 500 kV. The power distribution system 140 may be configured to supply AC and/or DC power to the electrodes 144 and may include transformers, AC/DC converters, and the like. The power distribution system 140 may include a generator and/or may be electrically connected to an external power source, such as a generator or grid power.

In some embodiments, the ERS-ISL system 100 (via the power distribution system 140) is configured to create a hydraulic conductivity within the ore body 110 of at least 1 ft/day, at least 2 ft/day, or at least 5 ft/day. Such embodiments may permit a minimum well flow of about 10 to 25 gallons/min. In some embodiments, the ERS-ISL system 100 is configured to increase a temperature of the ore body 110 (or at least a portion thereof) by at least 20 °C, at least 50 °C, or at least 100 °C. By way of example for copper, the feed acid may be 5 to 20 g/L, leaching treatment may occur for 100-300 days, or 150-240 days, and copper may be recovered in a concentration of 34.6 to 68.5 weight percent from a 0.28 to 1 weight percent grade ore, using an acid consumption of 5 to 50 kg acid per kg copper.

Figure 2:
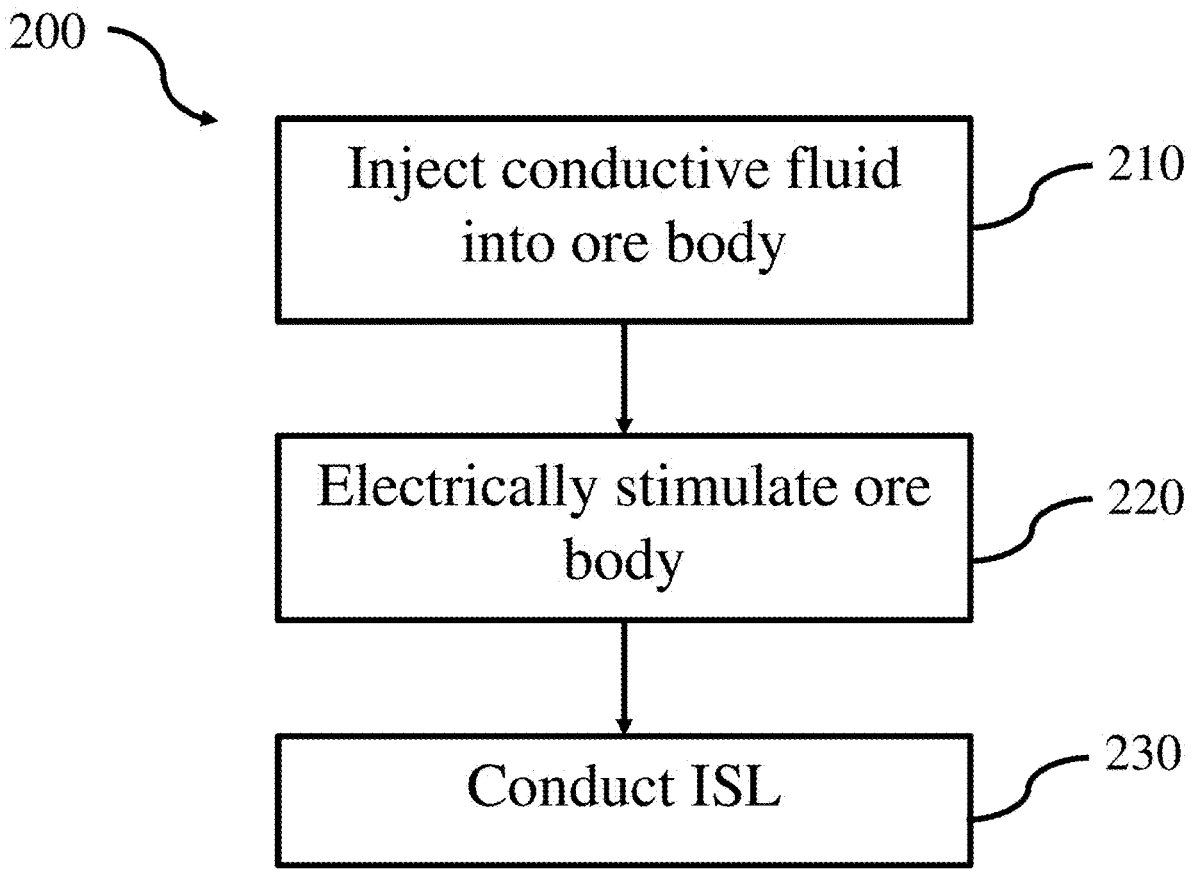
FIG. 2 is a flow chart of a method of ISL mining, according to some embodiments.

Referring to FIG. 2, during operation of the ERS-ISL system 100 according to a method 200, electrically conductive fluids are introduced via the one or more injection wells 120 in step 210. The injection and/or recovery wells, or all applicable wells, may be capped with a protective casing along a portion or substantially all or all of the depth of the downhole tubing. The casing can also minimize or prevent leakage of fluids (leachate or recovery) above a desired depth. For example, a casing may be used over the tubing through any upper and lower basin fill conglomerate or other surface layer(s), and the tubing may then be exposed in the oxide zone, sulfide zone, or both. In some embodiments, the electrically conductive fluids are the recovery solution or leachate solution. In some embodiments, the electrically conductive fluids do not include a proppant. In other embodiments, the electrically conductive fluids include a proppant suspended therein. In step 220, electrical stimulation via the power distribution system 140 fractures rock in situ by using oppositely charged electrodes 144 within the wells 120, 130. The fracturing of the ore body 110 may be achieved by a combination of hydraulic fracturing, pulsed power (electric shock) to produce shock waves within the ore body 110, and joule heating to fracture ore by thermal shock via DC or AC power. Any one or more of these fracturing methods may be used with preference given to the most effective methods based on the makeup of the ore body 110. The result is the fracturing of the ore body 110 in-situ, which enables ISL by fracturing the ore body 110 to open porosity to permit entry of and/or facilitate through flow rate of the leachate. This increases leachate-mineral interaction volume and increases the ability of the leachate solution to flow through the ore body 110 to migrate dissolved and/or desorbed minerals and avoid saturation at the leachate-mineral surface. Joule heating may be used to control reservoir temperature within the ore body 110 to catalyze critical mineral dissolution and/or desorption by leachate-mineral or leach-organic matter interaction. The joule heating also optimizes $CO_2$-ore or carbon-negative reaction kinetics—if a carbon-bearing leachate is used—by increasing formation temperature and surface reactivity. This is because $CO_2$ mineralization is firmly temperature dependent and follows a bell-shaped curve with a maximum at 185 °C and is exothermic ($\Delta H$=760 kJ/kg).

The leachates involved in dissolution of Cu—, Ni—, Fe—, Au—, Ag—, Li—, Co—, W—, Sn—, REE-, as well as all other materials, can be organic acids, oxidizing agents, water, other acids, alkaline solutions, chelating agents, a mix of these classes of leachates, or some other classes altogether. In some exemplary laboratory embodiments, organic acids were used to leach Ni- and Fe-rich pulsed power fractured ores.

The leachates involved in $CO_2$ mineralization are malonic acid, succinic acid, $CO_2$-saturated brine, super critical $CO_2$, oxalic acid, citric acid, or combinations thereof, or some other carbon-containing fluid altogether. In one exemplary laboratory embodiment, pulsed power fractured sample allowed for larger extent of $CO_2$ mineralization without decreasing its permeability relative to hydraulically fractured sample of the same lithology.

The range of temperatures under which the embodiments disclosed herein may operate includes ranges from 5 °C to 300 °C. In some embodiments, the operating temperature may be 185 °C. In some embodiments, the temperature under which a sample mineralized $CO_2$ was 30 °C. In some embodiments, the operating temperature may be an ambient temperature. The embodiments disclosed herein may be employed in any suitable range of operating temperatures as the disclosure is not so limited.

The ERS-ISL system 100 also enables oxidation of redox-sensitive minerals. Large amounts of oxygen are usually required to oxidize redox-sensitive minerals and oxygen solubility in aqueous solution is insufficient. As such, leaching requiring oxidation would typically not meet commercial production rates. However, ERS facilitates oxidation-reduction reactions between the electrodes 144 in the ore body 110 to oxidize redox-sensitive critical minerals (e.g., critical minerals in sulfide form such as pyrite) at the anode to oxidize iron and can combine such oxidized minerals with formation fluids to create weak acids (e.g., sulfuric acid) to dissolve commodities (e.g., copper) in solution to precipitate more economic minerals to beneficiate (e.g., chalcocite) encountering reducing conditions at the cathode.

In step 230, ISL is conducted, having been facilitated and/or enhanced by the ERS. Step 230 may optionally include additional electrical stimulation, such as pulsed power, thermal shock, and/or joule heating to further enhance the ISL operation. In some embodiments, step 230 may occur simultaneously with step 210, in that step 210 may be part of an ISL operation.

Figure 3:
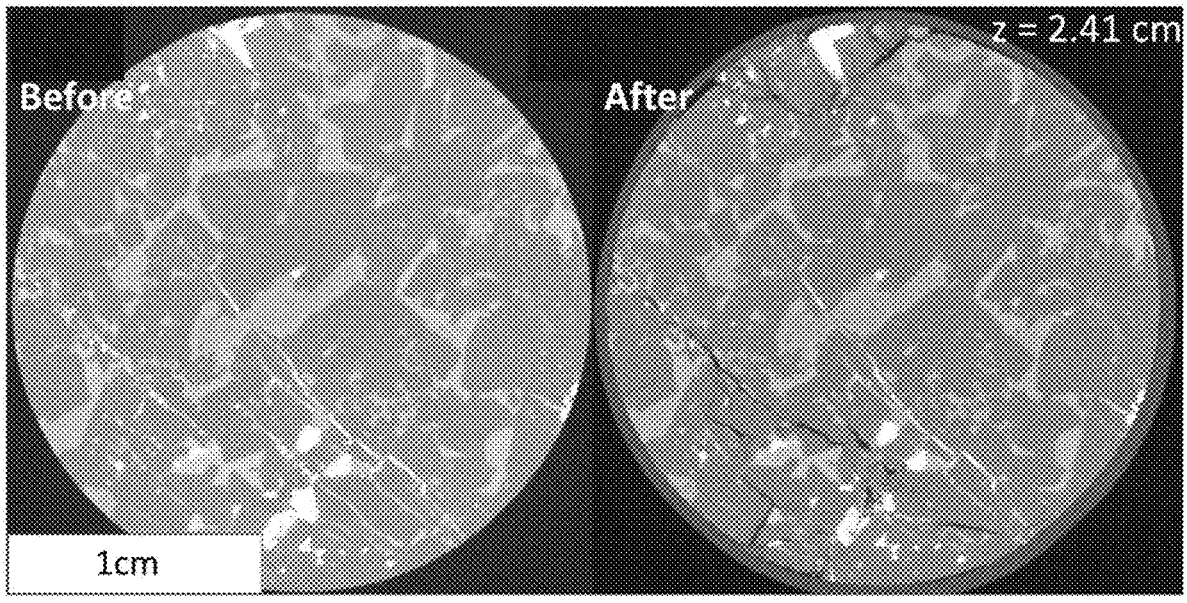
FIG. 3 is a cross-sectional view of a mafic intrusion before and after being subjected to pulsed electrical power, according to some embodiments.

The system, apparatus, and method disclosed herein may provide one or more of the following:

- fracturing of ore to open porosity and permeability to permit entry of leachate to increase leachate-mineral or leachate-organic matter interaction volume;
- preferential fracturing and expanding along vein and grain boundaries (based on type of ore) via ERS to enhance leaching due to the larger conductivity of metal-containing grains and minerals relative to the aluminosilicate background gangue mineralogy. In some exemplary laboratory embodiments, critical minerals and base metals (e.g., Cu-, Ni-, and Fe-rich oxides and sulfides) were fractured along major metal-bearing veins (as shown in FIG. 3). Leaching of these samples lead to higher yields relative to fractures generated via hydraulic fracturing, which results in indiscriminate fracturing not along vein and grain boundaries;

increased ability of leachate to flow through the ore to migrate dissolved and/or desorbed minerals and avoid saturation at the leachate-mineral surface;

control of reservoir temperature to catalyze critical mineral dissolution and/or dissolution by leachate-mineral interaction;

when the leachate is carbon-bearing leachate (e.g., $CO_2$-bearing and organic acids), catalysis of carbon mineralization of the carbon-reactive gangue or tailing mineralogy for geologic carbon storage during ISL;

facilitation of the dissolution and reprecipitation of redox-sensitive minerals (e.g., sulfides) by electrochemical and chemical oxidation-reduction reactions between the electrodes in the ore body, wherein redox-sensitive minerals, e.g., pyrite ($FeS_2$), chalcopyrite ($CuFeS_2$), and bornite ($Cu_5FeS_4$) are oxidized, the oxidation of iron contained within these minerals is converted to iron oxide, sulfur can be combined with formation fluids to produce a weak acid solution (e.g., sulfuric acid), and critical minerals (e.g., copper) are dissolved in the weak acid (e.g., sulfuric acid) solution until reducing conditions dominate to promote the precipitation of more economically favorable minerals to beneficiate, e.g., chalcocite ($Cu_2S$) for later excavation;

dissolution of critical minerals by oxidizing agents or oxidation at the anode and recovery of the metal-impregnated solutions at the surface; and/or clay dewatering to increase permeability, porosity, and critical mineral extraction.

The system, apparatus, and method disclosed herein may include any one or more of the following features or capabilities:

ERS enables ISL by fracturing the ore body to open porosity and permeability to permit entry, or even increased flow throughput, of leachate (e.g., organic acids, oxidizing agents, water, other acids, alkaline solutions, chelating agents) to increase leachate-mineral interaction volume;

ERS enables ISL by increasing the ability of leachate (e.g., organic acids, oxidizing agents, water, other acids, alkaline solutions, chelating agents) to flow through the ore body to migrate dissolved and/or desorbed minerals and avoid saturation at the leachate-mineral surface;

ERS catalyzes critical mineral dissolution and/or desorption by leachate-mineral interaction (e.g., organic acids, oxidizing agents, water, other acids, alkaline solutions, chelating agents) by controlling formation temperature during ISL;

Provides the carbon-bearing leachate (e.g., $CO_2$-bearing and organic acids), ERS catalyzes carbon mineralization of the carbon-reactive gangue or tailing mineralogy for geologic carbon storage during ISL, which can advantageously provide for carbon capture and storage in a separate process or even the same processes to use leachate to extract minerals while storing carbon downhole;

ERS enhances the $CO_2$ mineralization rate;

ERS facilitates oxidation-reduction reactions between the electrodes in the ore body to oxidize redox-sensitive minerals (e.g., sulfides) at the anode to oxidize iron and combine sulfur with the electrically conductive fluid to create weak acids (e.g., sulfuric acid) which dissolve commodities (e.g., copper) in solution and precipitate more economic minerals to beneficiate (e.g., chalcocite) encountering reducing conditions at the cathode;

ERS enhances the dissolution of redox-sensitive critical minerals by oxidizing agents or oxidation at the anode for the mineral-impregnated solutions to be recovered at the surface;

ERS increases the temperature of targeted geological formations, triggering phase changes of certain minerals (e.g., low chalcocite to high chalcocite), leading to a change of the minerals' solubilities;

ERS enhances the rate of $CO_2$ mineralization during ISL in magmatic sulfide deposits (i.e., layered mafic intrusions), volcanogenic massive sulfide deposits, komatiite-hosted sulfide deposits, porphyry deposits and other mafic-ultramafic geologic formations, ore bodies, and tailings;

ERS enables ISL in magmatic sulfide deposits, volcanogenic massive sulfide deposits, komatiite-hosted sulfide deposits, porphyry deposits, iron oxide copper gold deposits, both high and low sulfidation epithermal deposits, skarn deposits, polymetallic carbonate replacement deposits, orogenic gold deposits, sedimentary exhalative deposits, lithium deposits (e.g., lithium-cesium-tantalum pegmatites, sedimentary lithium deposits, lithium granites and greisens), placer deposits, rare earth element carbonatites, Mississippi valley type deposits, shale deposits, coal deposits and other deposit types;

ERS using direct-current power devices and/or alternating-current power devices to apply high power electric fields enables ISL in ore bodies, geological formations, and tailings during ISL and/or enhances $CO_2$ mineralization in ore bodies, geological formations, and tailings during ISL;

ERS using pulsed electric power devices for electrical treatment generates shock waves which enable ISL in ore bodies, geologic formations, and tailings and/or enhance $CO_2$ mineralization in ore bodies, geologic formations, and tailings;

ERS, combined with the injection of engineered fluids, chemicals, or proppants, enhances $CO_2$ mineralization in ore bodies, geologic formations, and tailings during ISL;

ERS controls the reservoir temperature and/or increases the temperature of targeted geological formations to enhance the reaction kinetics of $CO_2$ mineralization in ore bodies, geologic formations, and tailings;

ERS controls electromagnetic fields to catalyze $CO_2$ mineralization in ore bodies, geologic formations, and tailings;

ERS results in a complex structure topology (fractures) and reactive surface areas to access larger volumes of rock and enhanced $CO_2$ mineralization in ore bodies, geologic formations, and tailings during ISL;

ERS, applied to in-situ or ex-situ (i.e., reactor) rock tailings, enhances $CO_2$ mineralization rate in ore bodies, geologic formations, and tailing during ISL;

ERS, applied to in-situ or ex-situ (i.e., reactor) rock tailings, enables ISL in ore bodies, geologic formations, and tailings during ISL;

Fluid and gas injection, combined with electrical treatment, enhances the $CO_2$ mineralization during ISL;

Fluid and gas injection, as a reservoir stimulation method, enables ISL;

ERS creates new fractures in geological formations, which enables ISL;

ERS enhances $CO_2$ sequestration during ISL; and/or

ERS facilitates clay dewatering to increase permeability, porosity, and critical mineral extraction yield.

Electrokinetics is the application of a direct or alternating electric field to accelerate the migration of charged species, such as metals, and water, which is a weakly charged molecule. The electric field facilitates the uniform migration of a suitable lixiviant and pregnant leach solution (PLS) through the ore body during in-situ leach mining. The migration of the suitable lixiviant and PLS through the ore body results in: (1) a migration of dissolved charged species towards the electrode of opposite charge; and (2) mass flow of the pore fluid containing uncharged species. The ability to also migrate uncharged species within the electric field is due to the diffuse double layer of certain mineral surfaces (e.g., phyllosilicates) that contain counter-ions that move toward the oppositely charged electrode; thus, transferring momentum to the uncharged fluid molecules to migrate in the same direction (i.e., electro-osmosis). Electro-osmosis controls reservoir fluid mobility and fluid separation between the anode and cathode electrode during ISL, resulting in the formation of eddy currents and fluid recirculation. The inventor(s) have appreciated that Eddy currents and fluid recirculation leads to larger water and rock residence times, enhancing the leaching potential of the lixiviant. The inventor(s) have conducted laboratory experiments and numerical simulations and found that that the electro-osmotic flow creates eddies in the lixiviant.

Laboratory Scale Experiments

In some exemplary embodiments, critical materials (Cu-, Ni-, and Fe-rich ores were fractured with ERS and fractures developed along vein and grain boundaries in each sample tested. This behavior was not observed in any samples fractured with uniaxial compression, Brazilian Test, or hydraulic fracturing.

Figure 4:
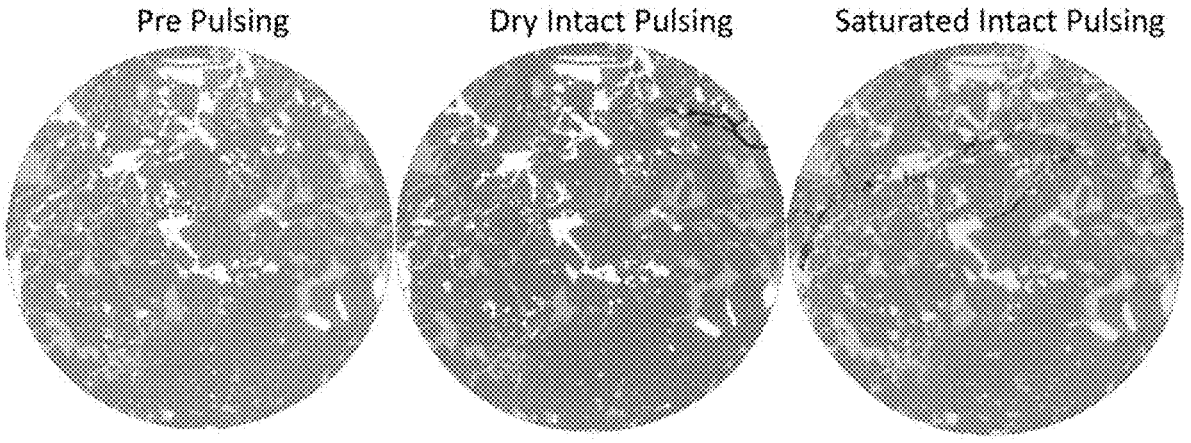
FIG. 4 is a cross-sectional view of a mafic intrusion during various stages of being subjected to pulsed electrical power, according to some embodiments.

According to some exemplary embodiments, in-situ leach mining tests were performed on layered mafic intrusion, rich in Ni (0.12 wt. % Ni) and Fe (7.0 wt. % Fe2O3). Samples were fractured with pulsed power and the fractures preferentially developed along sulfide veins, as shown in FIG. 3. In particular, FIG. 3 shows a cross-sectional view of a layered mafic intrusion before (a) and after (b) being subjected to pulsed electrical power. Samples were loaded into a core flooding cell, and flow through experiments were performed with in-situ stresses (mimicking pressures at 100 m depth) and temperatures (30 °C). Upon successful leaching, the leached sample was refractured with pulsed power to open new sulfide veins and leached once more, as shown in FIG. 4. In particular, FIG. 4 shows sequential pulsing of a layered mafic instruction with Ni-sulfide veins and grains at three stages: (a) a pre-pulsing stage, (b) a dry intact pulsing stage, and (c) a saturated intact pulsing stage post leaching. In some instances, providing pulsed power into the fluid-filled fractures once the sample is saturated caused shockwaves. The flow through reactor core flooding experiments on ERS-fractured Ni- and Fe-rich ores resulted in approximately a 1.6- and 3-fold increase in leaching efficiency, respectively, relative to hydraulically fractured Ni- and Fe-rich ores.

Figure 5A:
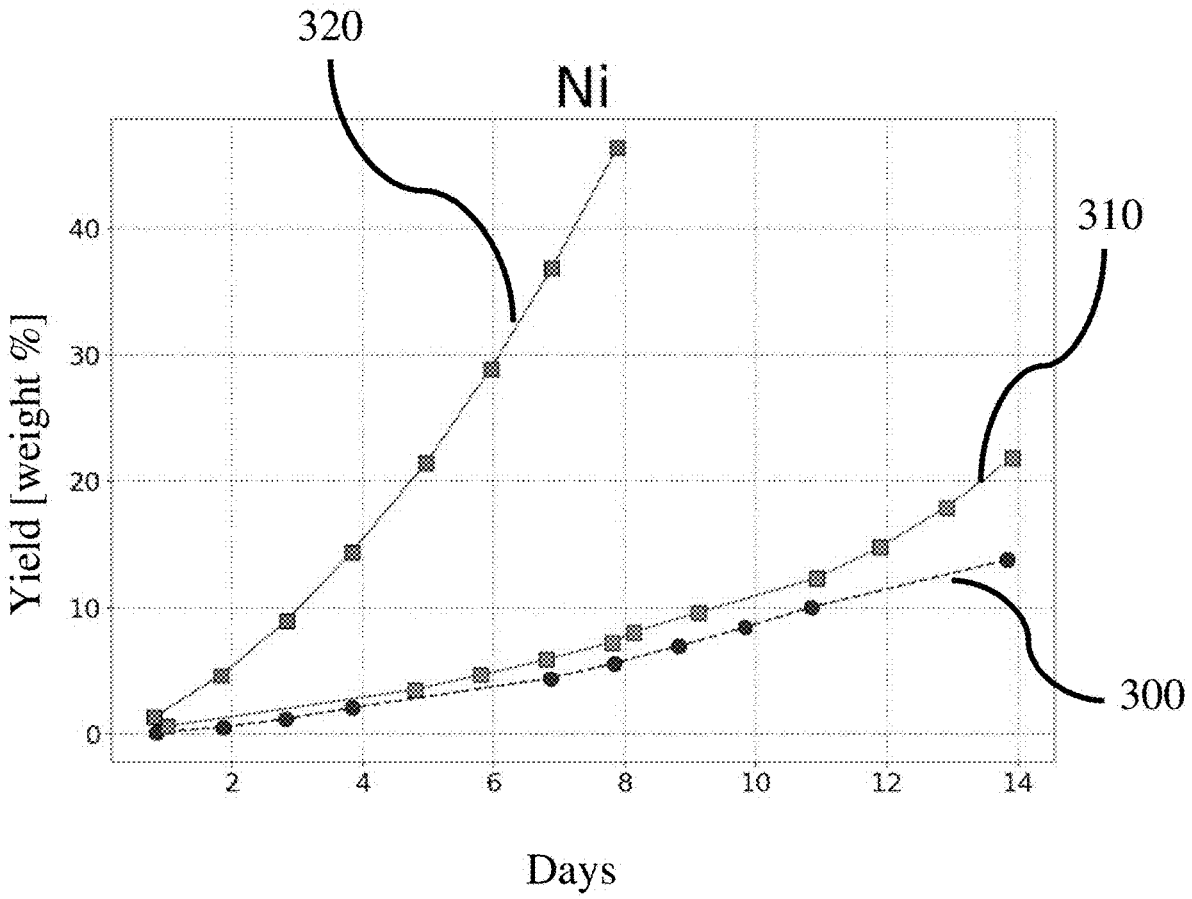
FIG. 5A shows a graph depicting yield for Ni in a leachate, according to some exemplary embodiments.
Figure 5B:
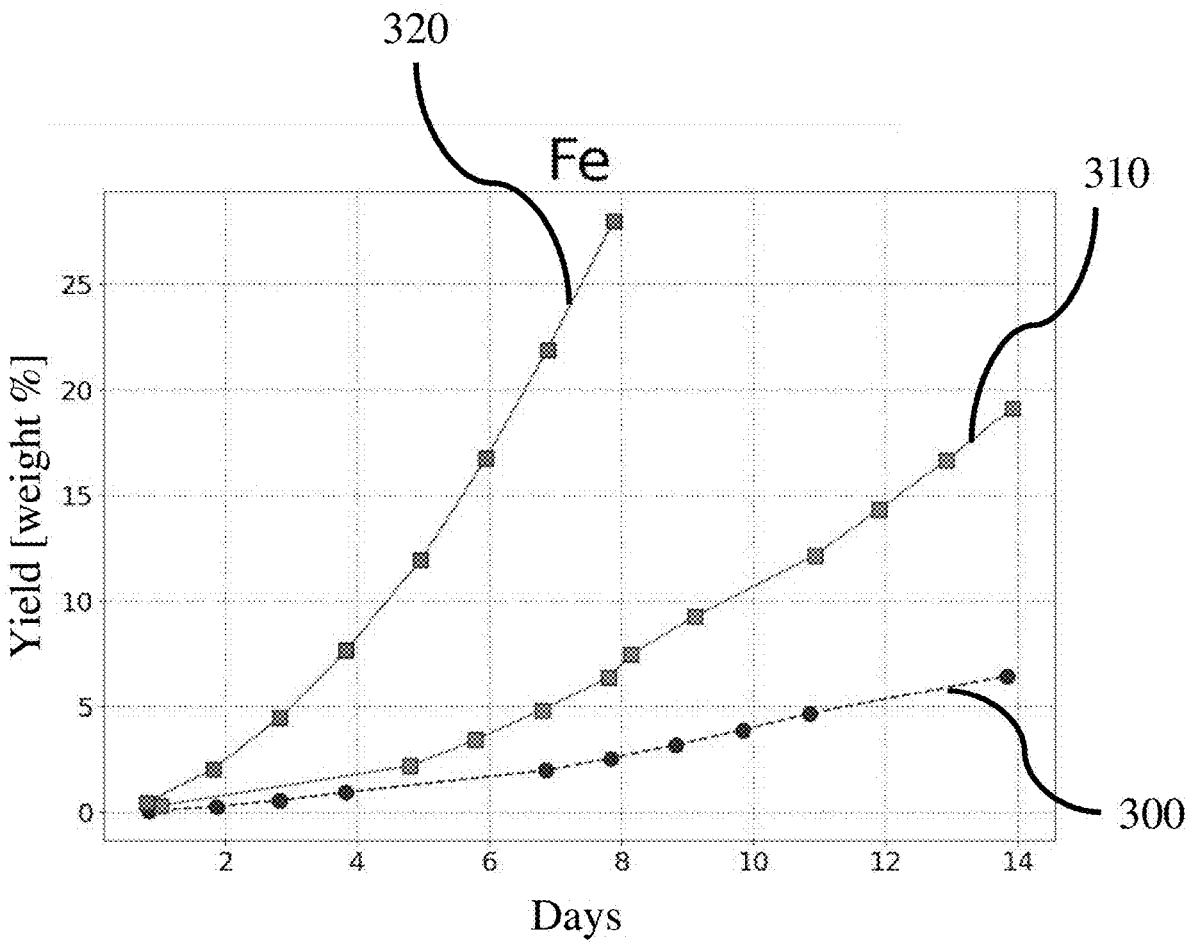
FIG. 5B shows a graph depicting yield for Fe in a leachate, according to some exemplary embodiments.

Results from the experiments were compared to a sample fractured via a Brazilian Test, generating a single planar fracture which may be comparable to what hydraulic fracturing would achieve in the field. FIG. 5A and FIG. 5B depicts weight percent yields for Ni and Fe, respectively, based on a wet chemistry analysis of the sample and aqueous concentrations of each chemical species in the leachate. Three different tests were used for the results depicted in FIGS. 5A-5B: a Brazilian Test (300), a pulsed power test with preferential fracturing along grain boundaries, e.g., dry pulsing (310), and a pulsed power test in which a shockwave was generated, e.g., post saturation of the sample (320). The sample fractured with pulsed power in which a shockwave was generated leached 896% more Fe (see FIG. 5B) and 647% more Ni (see FIG. 5A) relative to the sample fractured with Brazilian Test. In other words, the samples were further refractured and new fractures were created with ERS post-leaching and even higher leaching efficiency, relative to hydraulically fractured sample, was observed afterwards, i.e., an approximately 6.5-fold and 9-fold increase in leaching efficiency for Ni and Fe, respectively.

Various embodiments include providing a current through the recovery solution (e.g., by providing a potential difference across two or more electrodes adjacent to the recovery solution). In some embodiments, an electric pulse can be administered via a pulsed power device (e.g., an AC current). In some embodiments, the electric pulse has a voltage of greater than or equal to 1 V, greater than or equal to 5 V, greater than or equal to 10 V, greater than or equal to 50 V, greater than or equal to 100 V, greater than or equal to 500 V, greater than or equal to 1 kV, greater than or equal to 5 kV, greater than or equal to 10 kV, greater than or equal to 50 kV, greater than or equal to 100 kV, greater than or equal to 500 kV, greater than or equal to 600 kV, greater than or equal to 700 kV, greater than or equal to 800 kV, or greater than or equal to 900 kV. In some embodiments, the electric pulse has a voltage of less than or equal to 1,000 kV, less than or equal to 900 kV, less than or equal to 800 kV, less than or equal to 700 kV, less than or equal to 600 kV, less than or equal to 500 kV, less than or equal to 100 kV, less than or equal to 50 kV, less than or equal to 10 kV, less than or equal to 5 kV, less than or equal to 1 kV, less than or equal to 500 V, less than or equal to 100 V, or less than or equal to 50 V. Combinations of the foregoing ranges are also possible (e.g., greater than or equal to 100 kV and less than or equal to 1,000 kV). In another embodiment, the voltage may be between or equal to 1 kV and 100 kV. Other ranges are possible as this disclosure is not so limited.

In some embodiments, a pulse power device administers an electric pulse with a particular amount of power. In some embodiments, the electric pulse has a power of greater than or equal to 0.5 MW, greater than or equal to 0.6 MW, greater than or equal to 0.7 MW, greater than or equal to 0.8 MW, greater than or equal to 0.9 MW, greater than or equal to 1 MW, greater than or equal to 5 MW, greater than or equal to 10 MW, greater than or equal to 50 MW, greater than or equal to 100 MW, or greater than or equal to 500 MW. In some embodiments, the electric pulse has a power of less than or equal to 1,000 MW, less than or equal to 500 MW, less than or equal to 100 MW, less than or equal to 50 MW, less than or equal to 10 MW, less than or equal to 5 MW, or less than or equal to 1 MW. Combinations of the above-referenced ranges are also possible (e.g., greater than or equal to 0.5 MW and less than or equal to 1,000 MW). Of course, other ranges are possible as this disclosure is not so limited.

In some embodiments, an electric current can be administered via a DC power device. In some embodiments, the DC power devices provides electric current by providing a voltage of greater than or equal to 1 V, greater than or equal to 5 V, greater than or equal to 10 V, greater than or equal to 50 V, greater than or equal to 100 V, greater than or equal to 500 V, greater than or equal to 1 kV, greater than or equal to 5 kV, greater than or equal to 10 kV, greater than or equal to 50 kV, greater than or equal to 100 kV, greater than or equal to 500 kV, greater than or equal to 600 kV, greater than or equal to 700 kV, greater than or equal to 800 kV, or greater than or equal to 900 kV. In some embodiments, the DC power device provides a voltage of less than or equal to 1,000 kV, less than or equal to 900 kV, less than or equal to 800 kV, less than or equal to 700 kV, less than or equal to 600 kV, less than or equal to 500 kV, less than or equal to 100 kV, less than or equal to 50 kV, less than or equal to 10 kV, less than or equal to 5 kV, less than or equal to 1 kV, less than or equal to 500 V, less than or equal to 100 V, or less than or equal to 50 V. Combinations of the foregoing ranges are also possible (e.g., greater than or equal to 100 kV and less than or equal to 1,000 kV). In another embodiment, the voltage is between or equal to 1 kV and 100 kV. Other ranges are possible as this disclosure is not so limited.

In some embodiments, a DC power device administers an electric current with a particular amount of power. In some embodiments, the electric current has a power of greater than or equal to 0.5 MW, greater than or equal to 0.6 MW, greater than or equal to 0.7 MW, greater than or equal to 0.8 MW, greater than or equal to 0.9 MW, greater than or equal to 1 MW, greater than or equal to 5 MW, greater than or equal to 10 MW, greater than or equal to 50 MW, greater than or equal to 100 MW, greater than or equal to 500 MW, or greater than or equal to 1,000 MW. In some embodiments, the electric current has a power of less than or equal to 1,000 MW, less than or equal to 500 MW, less than or equal to 100 MW, less than or equal to 50 MW, less than or equal to 10 MW, less than or equal to 5 MW, or less than or equal to 1 MW. Combinations of the above-referenced ranges are also possible (e.g., greater than or equal to 0.5 MW and less than or equal to 1,000 MW). Of course, other ranges are possible as this disclosure is not so limited.

The two or more electrodes may each be any suitable electrode for applying a potential across the reservoir. In some embodiments, the two or more electrodes are configured to apply a voltage potential between a first portion of the reservoir and a second portion of the reservoir. In some such embodiments, the applied voltage potential heats the reservoir (e.g., via Joule heating) due to the flow of current between the two or more electrodes located in at least the first and second portions of the reservoir.

In some embodiments, a fracture network associated with one or more reservoirs can be mapped or imaged. As described above and elsewhere herein, the recovery solution may include a leachate and depending on the embodiment a conductive proppant or non-conductive proppant which may penetrate portions of a reservoir, and any fractures associated with the reservoir. In some embodiments, as the recovery solution is pumped into a reservoir, it may create new fractures and/or cause existing fractures to propagate. In some such embodiments, the conductive material may infiltrate at least some portions of the fractures while not penetrating at least some other portions of the fracture. Advantageously, the fracture network may be characterized from a position above a subterranean reservoir, for example, from a position on the surface of near a drill site. In some embodiments, electromagnetic radiation is applied to the reservoir, and one or more resulting signals related to the applied electromagnetic radiation may be received from the reservoir. These signals may be used to determine one or more properties of the reservoir and/or the associated fracture network can be determined based, at least in part, on the one or more signals.

As used herein, a well may refer to a borehole extending into a geological feature. For example, a borehole may extend through one or more strata disposed between an upper ground surface of a formation and a reservoir that the bore hole is used to access. This may include applications such as, petroleum producing reservoirs (e.g., oil and gas producing reservoirs); water reservoirs; geothermal reservoirs; and/or any other appropriate geological feature that a borehole may be formed in.

Although the present disclosure has been described using preferred embodiments and optional features, modification and variation of the embodiments herein disclosed can be foreseen by those of ordinary skill in the art, and such modifications and variations are considered to be within the scope of the present disclosure. It is also to be understood that the above description is intended to be illustrative and not restrictive. For instance, it is noted that the diameter, length, thickness, and density values described above are illustrative only and can be readily adjusted by one of ordinary skill in the art to fit a wide range of potential reactors and processes. Many alternative embodiments will be apparent to those of ordinary skill in the art upon reviewing the above description. Additionally, the terms and expressions employed herein have been used as terms of description and not of limitation, and there is no intention in the use of such terms and expressions of excluding any equivalents of the future shown and described or any portion thereof, and it is recognized that various modifications are possible within the scope of the disclosure.

The invention claimed is:

1. A method of conducting in situ leach mining, comprising:

injecting a leaching solution into an ore body, wherein the ore body comprises a mineral;

electrically stimulating the ore body by delivering electrical power through the ore body between a first electrode and a second electrode to generate fractures in the ore body and increase a permeability of the ore body; and dissolving and/or desorbing the mineral in the leaching solution.

2. The method of claim 1, further comprising injecting an electrically conductive fluid into the ore body, wherein the electrically conductive fluid comprises the leaching solution, and wherein electrically stimulating the ore body includes delivering the electrical power through the electrically conductive fluid between the first and second electrodes.

3. The method of claim 1, further comprising controlling a temperature of the ore body by electrically stimulating the ore body.

4. The method of claim 1, wherein the leaching solution comprises a $CO_2$ bearing leachate and/or an organic acid; and wherein electrically stimulating the ore body catalyzes carbon mineralization.

5. The method of claim 1, wherein the ore body comprises sulfide deposits, volcanogenic massive sulfide deposits, komatiite-hosted sulfide deposits, porphyry deposits, iron oxide copper gold deposits, high sulfidation epithermal deposits, low sulfidation epithermal deposits, skarn deposits, polymetallic carbonate replacement deposits, orogenic gold deposits, sedimentary exhalative deposits, lithium deposits, placer deposits, rare earth element carbonatites, shale deposits, coal deposits, or combinations thereof.

6. The method of claim 1, wherein the first and second electrodes comprise an anode and a cathode; and wherein electrically stimulating the ore body oxidizes redox-sensitive minerals contained within the ore body at the anode and precipitates other minerals contained within the ore body at the cathode.

7. The method of claim 6, wherein the ore body comprises sulfides and copper; wherein the redox-sensitive minerals are the sulfides and oxidation of the sulfides forms a weak acid in which the copper is soluble; and wherein the method further comprises dissolving the copper in the weak acid and removing the copper from the ore body through an extraction well.

8. The method of claim 1, wherein electrically stimulating the ore body comprises delivering pulsed power current between the first and second electrode.

9. The method of claim 1, further comprising positioning the first electrode in an injection well and further comprising positioning the second electrode in an extraction well.

10. A system for in situ leach mining, comprising:

an injection well configured to inject a leaching solution into an ore body, wherein the ore body comprises a mineral, wherein the mineral is soluble in the leaching solution and/or the leaching solution is capable of desorbing the mineral;

an extraction well adjacent the injection well;

a first electrode electrically associated with the ore body and positioned within the injection well;

a second electrode electrically associated with the ore body and positioned within the extraction well; and a power distribution system electrically connected to the first and second electrodes and configured to electrically stimulate the ore body to generate fractures in the ore body.

11. The system of claim 10, wherein the power distribution system is configured to provide pulsed power between the first and second electrodes to increase a permeability of the ore body.

12. The system of claim 10, wherein the power distribution system is configured to provide DC and/or AC power between the first and second electrodes to control a temperature of the ore body.

13. The system of claim 10, further comprising an electrically conductive fluid supply in fluid communication with the injection well and configured to inject an electrically conductive fluid into the ore body through the injection well, wherein the electrically conductive fluid comprises the leaching solution.

14. The system of claim 10, wherein the ore body comprises at least one of oxide deposits and sulfide deposits, the oxide and/or sulfide deposits comprising at least one selected from copper, nickel, and iron.

15. A method of conducting in situ leach mining, comprising:

electrically stimulating an ore body by delivering electrical power through the ore body between a first electrode and a second electrode;

wherein electrically stimulating the ore body generates fractures in the ore body preferentially along grain boundaries and increases a permeability of the ore body.

16. The method of claim 15, further comprising injecting an electrically conductive fluid into the ore body, wherein electrically stimulating the ore body comprises delivering the electrical power through the electrically conductive fluid between the first electrode and the second electrode.

17. The method of claim 15, wherein the preferential fracturing along grain boundaries results in a 1.6-fold increase or greater in leaching efficiency.

18. The method of claim 15, further comprising controlling a temperature of the ore body by electrically stimulating the ore body.

19. The method of claim 15, further comprising injecting a leaching solution into the ore body, wherein the ore body comprises a mineral, wherein the mineral is soluble in the leaching solution and/or the leaching solution is capable of desorbing the mineral.

20. The method of claim 15, wherein the ore body comprises sulfide deposits, volcanogenic massive sulfide deposits, komatiite-hosted sulfide deposits, porphyry deposits, iron oxide copper gold deposits, high sulfidation epithermal deposits, low sulfidation epithermal deposits, skarn deposits, polymetallic carbonate replacement deposits, orogenic gold deposits, sedimentary exhalative deposits, lithium deposits, placer deposits, rare earth element carbonatites, shale deposits, coal deposits, or combinations thereof.

21. The method of claim 15, wherein the first and second electrodes comprise an anode and a cathode; and wherein electrically stimulating the ore body oxidizes redox-sensitive minerals contained within the ore body at the anode and precipitates other minerals contained within the ore body at the cathode.

22. The method of claim 21, wherein the ore body comprises sulfides and copper; wherein the redox-sensitive minerals are the sulfides and oxidation of the sulfides forms a weak acid in which the copper is soluble; and wherein the method further comprises dissolving the copper in the weak acid and removing the copper from the ore body through an extraction well.

23. The method of claim 15, wherein electrically stimulating the ore body comprises delivering pulsed power current between the first and second electrodes.

24. The method of claim 15, further comprising positioning the first electrode in an injection well and further comprising positioning the second electrode in an extraction well.

25. A system for in situ leach mining, comprising:

a first electrode electrically associated with an ore body and positioned within a first well;

a second electrode electrically associated with the ore body and positioned within a second well; and a power distribution system electrically connected to the first and second electrodes and configured to electrically stimulate the ore body to generate fractures in the ore body preferentially along grain boundaries.

26. The system of claim 25, wherein the preferential fracturing along grain boundaries results in a 1.6-fold increase or greater in leaching efficiency.

27. The system of claim 25, wherein the power distribution system is configured to provide pulsed power between the first and second electrodes to increase a permeability of the ore body.

28. The system of claim 25, wherein the power distribution system is configured to provide DC and/or AC power between the first and second electrodes to control a temperature of the ore body.

29. The system of claim 25, wherein the first well is an injection well and the second well is an extraction well, wherein the injection well is configured to inject an electrically conductive fluid into the ore body, and further comprising an electrically conductive fluid supply in fluid communication with the injection well.

30. The system of claim 25, wherein the ore body comprises at least one of oxide deposits and sulfide deposits, the oxide and/or sulfide deposits comprising at least one selected from copper, nickel, and iron.

* * * * *